US008081050B2

(12) United States Patent
Kaneda et al.

(10) Patent No.: US 8,081,050 B2
(45) Date of Patent: Dec. 20, 2011

(54) MULTILAYER PLANAR TUNABLE FILTER

(75) Inventors: Noriaki Kaneda, Westfield, NJ (US); Yves Baeyens, Stirling, NJ (US); Young-Kai Chen, Berkeley Heights, NJ (US)

(73) Assignee: Alcatel Lucent, Paris (FR)

( * ) Notice: Subject to any disclaimer, the term of this patent is extended or adjusted under 35 U.S.C. 154(b) by 307 days.

(21) Appl. No.: 12/392,924

(22) Filed: Feb. 25, 2009

(65) Prior Publication Data

US 2010/0214040 A1 Aug. 26, 2010

(51) Int. Cl.
*H01P 3/08* (2006.01)

(52) U.S. Cl. ..... 333/204; 333/238

(58) Field of Classification Search ..... 333/204, 333/238, 246
See application file for complete search history.

(56) References Cited

U.S. PATENT DOCUMENTS

| | | | | |
|---|---|---|---|---|
| 6,121,861 | A * | 9/2000 | Yabuki et al. | 333/204 |
| 6,643,924 | B2 * | 11/2003 | Hirabayashi | 29/846 |
| 6,812,813 | B2 * | 11/2004 | Mizoguchi et al. | 333/204 |
| 7,193,490 | B2 * | 3/2007 | Shimoda | 333/246 |
| 2007/0182512 | A1 | 8/2007 | Lee et al. | |

* cited by examiner

*Primary Examiner* — Stephen Jones
(74) *Attorney, Agent, or Firm* — Hitt Gaines P.C.

(57) ABSTRACT

An electronic device includes a first strip conductor formed from a first metal level over a substrate. A second strip conductor formed from a second metal level is located between the first strip conductor and the substrate. At least one of the first and the second strip conductors includes a stripline portion and a microstrip line portion.

24 Claims, 7 Drawing Sheets

MULTILAYER PLANAR TUNABLE FILTER

TECHNICAL FIELD

This application is directed, in general, to a radio frequency filter and, more specifically, to a planar waveguide filter.

BACKGROUND

Compact devices using radio frequency (RF) signals are commonplace. Many such devices use filters to, e.g., select a portion of a received RF spectrum for further processing. The limited space available for filters in a compact device may constrain possible filter design or limit the degree to which the size of the device may be reduced.

SUMMARY

One aspect provides an electronic device that includes a first strip conductor formed from a first metal level over a substrate. A second strip conductor formed from a second metal level is located between the first strip conductor and the ground plane. At least one of the first and the second strip conductors includes a stripline portion and a microstrip portion.

Another aspect provides a method. A first strip conductor is formed over a substrate. A second strip conductor is formed between the substrate and the first strip conductor. At least one of the first and the second strip conductors includes a stripline portion and a microstrip portion.

Another aspect provides a method. A radio frequency signal is filtered with a first filter circuit having a strip conductor and located over a ground plane. The first planar waveguide circuit is configured to have a first frequency response. The radio frequency signal is filtered by a second planar waveguide circuit located between the first planar waveguide circuit and the ground plane. The second planar waveguide circuit is configured to have a different second filter response. At least one of the first and the second planar waveguide circuits includes a stripline portion and a microstrip portion.

BRIEF DESCRIPTION

The disclosure is best understood from the following detailed description when read with the accompanying Figures. Various features in the Figures are not necessarily drawn to scale. The dimensions of the various features may be arbitrarily increased or reduced for clarity of discussion. Reference is now made to the following descriptions taken in conjunction with the accompanying drawings, in which.

DETAILED DESCRIPTION

Figure 1:
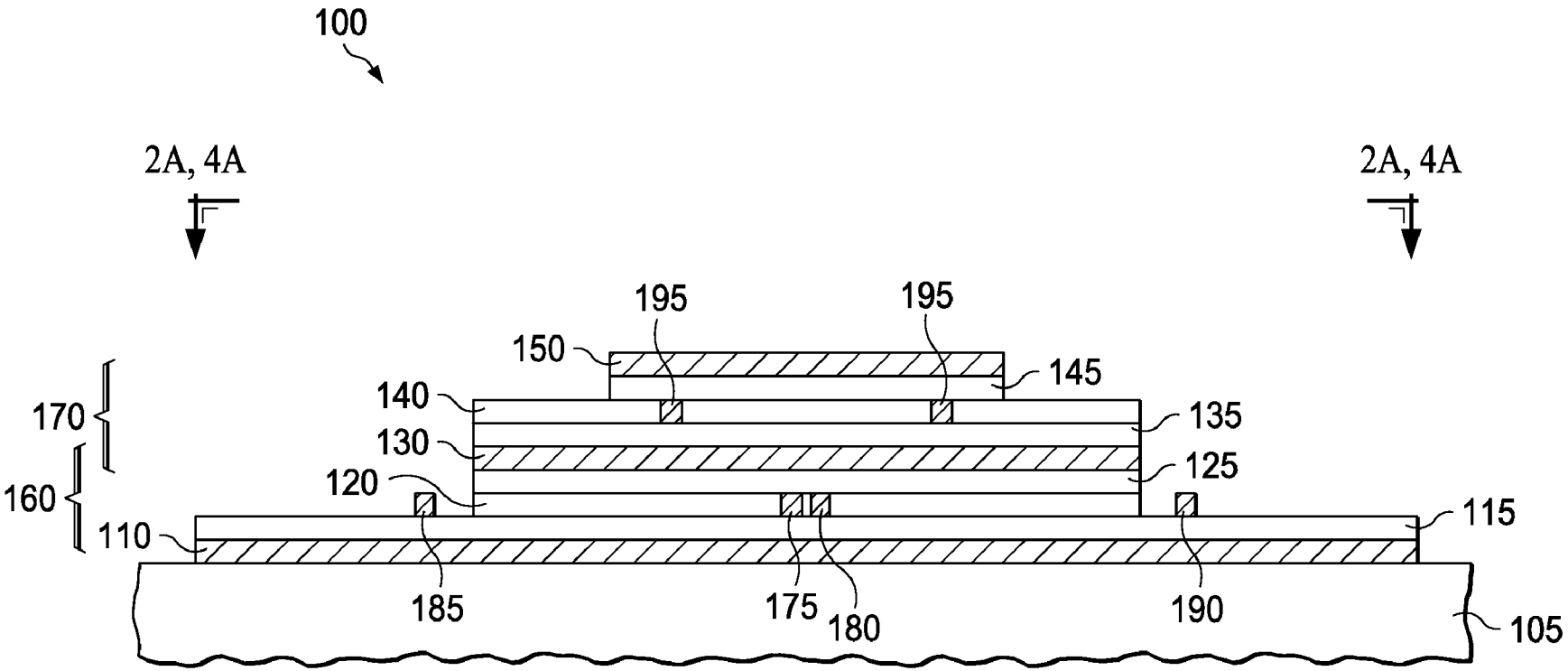
FIG. 1 is a sectional view of an electronic device of the disclosure.

FIG. 1 illustrates a sectional view of an electronic device 100 of the disclosure. The device 100 includes nine levels over an optional substrate 105 in this example embodiment. The levels are designated 110, 115, 120, 125, 130, 135 145, 150. The levels 120, 140 are circuit levels that may include conducting and insulating features. The levels 110, 130, 150 are ground levels that may be substantially occupied by a conductor. Herein, a ground level may be configured to be electrically floating or to have a fixed potential. The levels 115, 125, 135, 145 are insulating layers that may be substantially occupied by a dielectric. It is understood that this specific arrangement of layers is presented as a nonlimiting embodiment, and that other embodiments using, e.g., a different total number of layers or a different number of circuit levels is within the scope of the disclosure.

The device 100 includes a planar waveguide circuit 160 and a planar waveguide circuit 170. The planar waveguide circuit 160 includes, e.g., the levels 110, 115, 120, 125, 130. The planar waveguide circuit 170 includes, e.g., the layers 130, 135, 140, 145, 150. As described further below, in the illustrated embodiment, e.g., the layer 130 is shared between the planar waveguide circuit 160 and the planar waveguide circuit 170. At least one of the planar waveguide circuits 160, 170 is a hybrid planar waveguide circuit. As also described in greater detail below, a hybrid planar waveguide circuit includes a continuous strip conductor path that has both a stripline and microstrip line portion. As used herein, a strip conductor is a conducting signal path located proximate to at least one floating or fixed-potential ground plane and configured to have a characteristic impedance, e.g., 50Ω. A "stripline portion" in the context of the levels 110, 120, 130, e.g., describes those portions of a strip conductor located between a ground plane on the level 110 and a ground plane on the level 130. For example, strip conductors 175, 180 are stripline portions. Portions of a strip conductor located over a ground plane on the level 110 but not associated with a ground plane on the level 130 are referred to as "microstrip line." For example, planar waveguide portions that include strip conductors 185, 190 are microstrip line portions.

Those skilled in the pertinent art understand that a microstrip line or a stripline planar waveguide is typically formed with a width that is selected to result in a desired characteristic impedance of the waveguide, e.g., 50Ω. The characteristic impedance of a stripline or microstrip line planar waveguide depends in part on the dielectric permittivity of an insulating layer between the metal trace and the one or two ground planes proximate the trace, and the thickness of the insulating layer(s). In the case of stripline, the distances between the metal trace and the two ground planes need not be equal. Examples of such insulating layers include FR4 and LTCC. FR4 is relatively low-cost glass/epoxy material with a relative permittivity of about 4.2. LTCC is a low temperature co-fired ceramic with relatively higher cost that may have a relative permittivity of about 7. Copper metal layers are typically used with FR4, and gold is typically used with LTCC, but the disclosure recognizes that any metal compatible with the insulating layers and conventional manufacturing techniques may be used. In the embodiments of the disclosure, ground plane and circuit levels may be formed from, e.g., copper, gold, silver, or any other conductor of similar resistivity. Dielectrics may be FR4, LTCC, or a polymer, e.g.

In FIG. 1, the planar waveguide circuits 160, 170 are illustrated over the substrate 105. The substrate 105 may be, e.g., a circuit board on which the device 100 is placed. Such placement may be desirable, e.g., in cases in which the device 100 operates in a larger circuit, components of which are formed by a different process from the device 100. In some cases, the substrate 105 may be a dielectric layer formed as part of a multilayer fabrication process used to form the device 100. Such a dielectric layer may be desirable, e.g., to provide additional mechanical support or protection to the device 100. Because the level 110 is substantially occupied by a ground plane, the substrate 105 does not generally electrically influence the device 100. When the optional substrate 105 is not otherwise present, the lowest ground level, e.g., the ground level 110, is regarded as the substrate for the purposes of the disclosure.

Figure 2A:
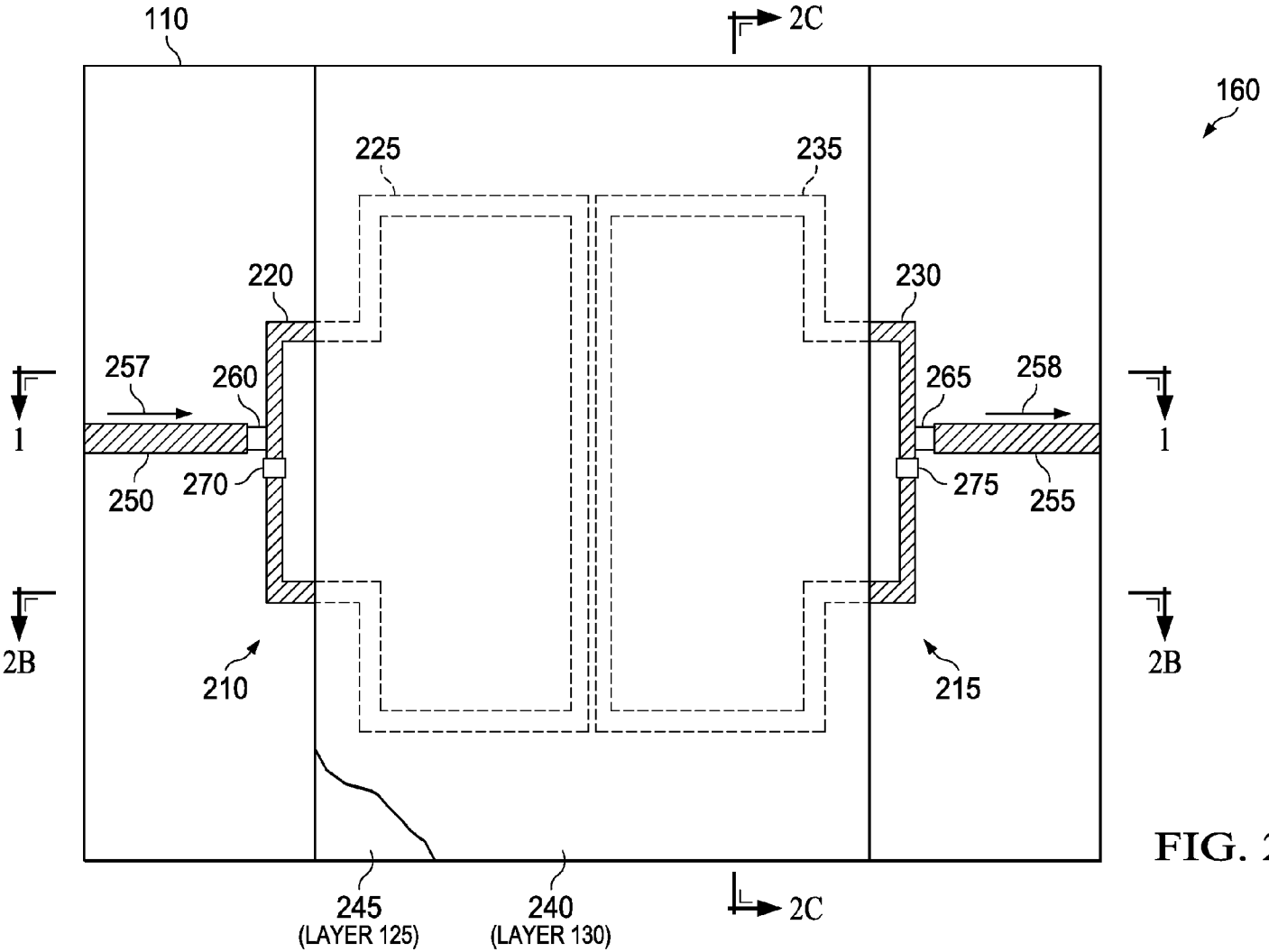
FIG. 2A is a plan view.
Figure 2B:
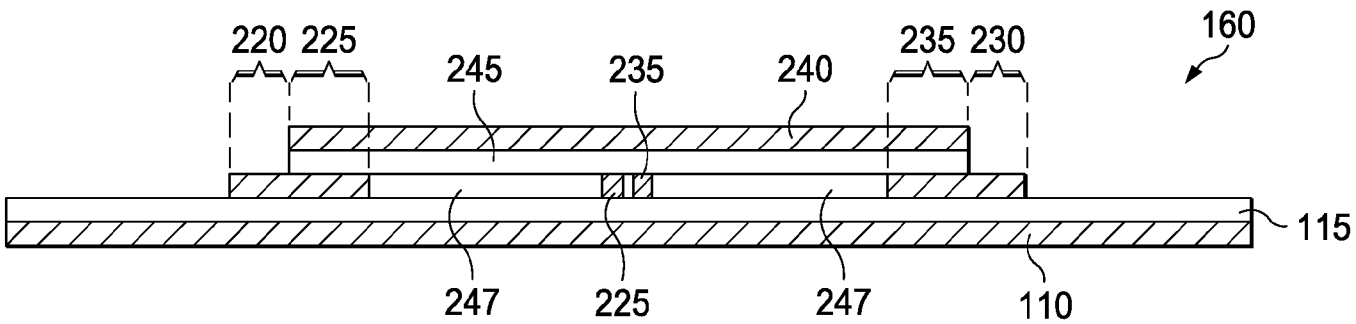
FIGS. 2B and 2C are sectional views of a hybrid planar waveguide circuit.
Figure 2C:
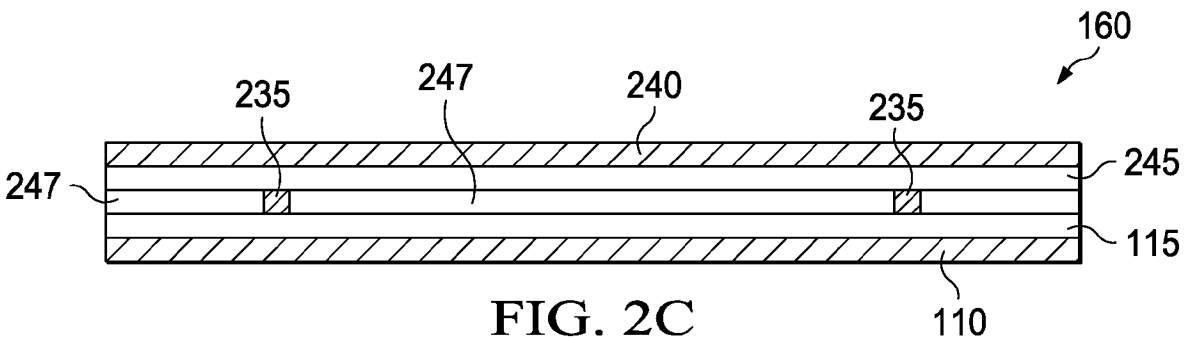

Turning to FIG. 2A, a plan view of an example embodiment of the planar waveguide circuit 160 is shown. Only the levels 110, 120, 125, 130 are shown for clarity. FIGS. 2B and 2C present sectional views of the planar waveguide circuit 160 to illustrate the relationship among the levels. Only the levels 110, 115, 120, 125 and 130 are shown in the sectional views for clarity. The section of FIG. 2B is taken horizontally through FIG. 2A as denoted therein, and the section of FIG. 2C is taken vertically, as denoted therein.

Referring to FIG. 2A, the planar waveguide circuit 160 includes, e.g., two split-rings 210, 215. The split-ring 210 includes a strip conductor 220 and a strip conductor 225. The strip conductor 220 is that portion of the split-ring 210 that is associated with the ground level 110, but is not associated with an overlying ground plane. The strip conductor 225 is that portion of the split-ring 210 that is located between the ground level 110 and the ground plane 240. The strip conductor 185 (FIG. 1) may be, e.g., the strip conductor 220 in cross-section. The strip conductor 175 may be, e.g., the strip conductor 225 in cross-section. The split-ring 215 similarly includes a strip conductor 230 and a strip conductor 235. The planar waveguide circuit 160 includes the ground level 110 and a ground plane 240 formed from the ground level metal layer 130. The ground plane 240 is supported by a dielectric spacer 245 (FIG. 2B) formed from the insulator layer 125, e.g. The strip conductor 190 (FIG. 1) may be, e.g., the strip conductor 230 in cross-section. The strip conductor 180 (FIG. 1) may be, e.g., the strip conductor 235 in cross-section. The strip conductors 225, 235 are those portions of the split-rings 210, 215 located between the ground level 110 and the ground plane 240, e.g. The strip conductors 220, 230 are those portions that lie over the ground level 110 but are not associated with an overlying ground plane.

FIG. 2B illustrates a sectional view of the planar waveguide circuit 160 as indicated in FIG. 2A. The relationships between the elements of the planar waveguide circuit 160 are shown for clarity of the description. The strip conductors 220, 230 are illustrated overlying the ground level 110. The strip conductors 225, 235 are illustrated located between the ground level 110 and the ground plane 240. Dielectric portions 247 occupy portions of the layer 120 not otherwise occupied by a conductor.

FIG. 2C illustrates a sectional view of the planar waveguide circuit 160 orthogonal to that of FIG. 2B, as indicated in FIG. 2A. In this view, the strip conductors 235 are again shown located between the ground planes 110, 240. No strip conductors associated with a microstrip line portion is visible in this view.

Figure 3:
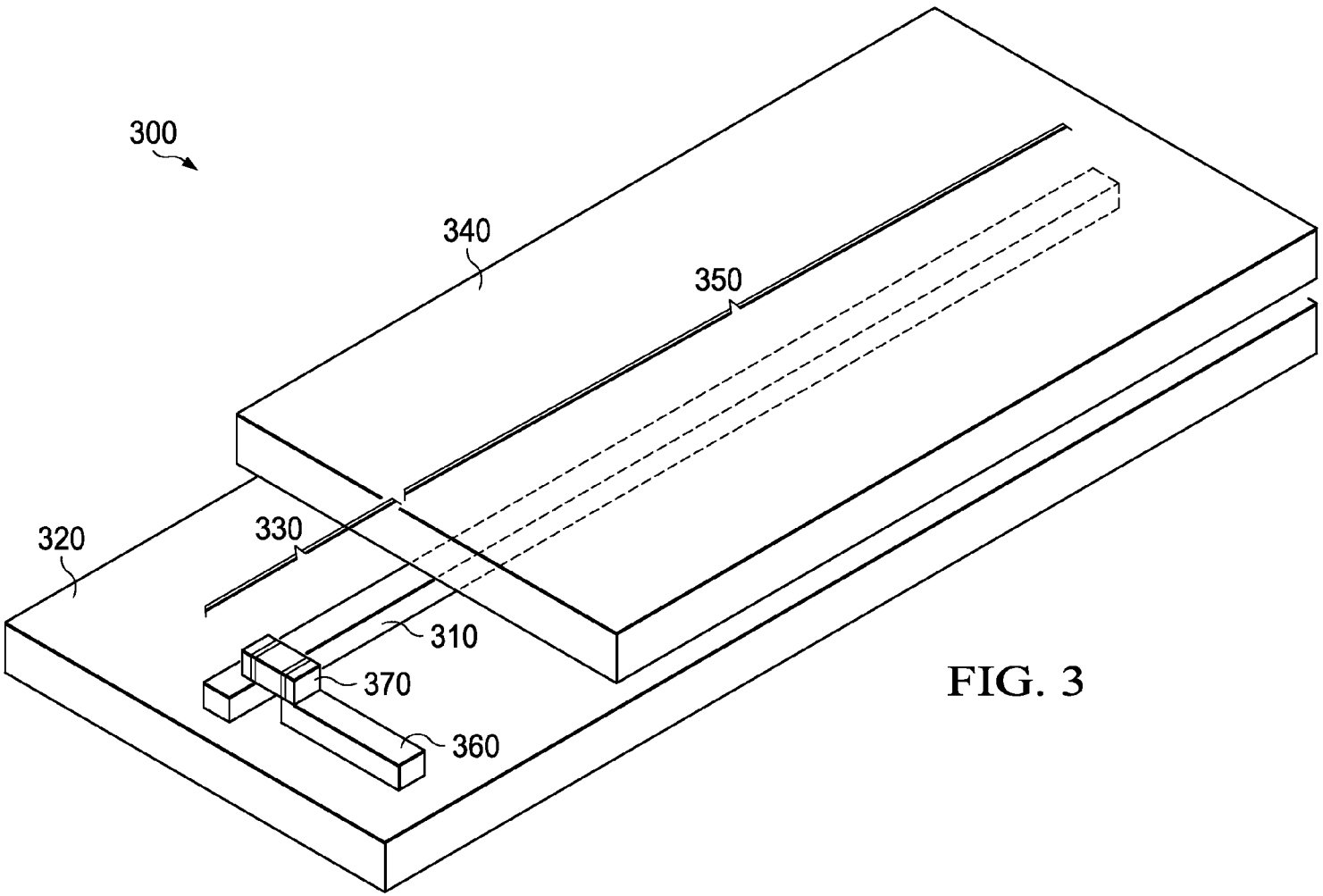
FIG. 3 is a detail view of a hybrid planar waveguide circuit.

At least one of the planar waveguide circuit 160 or the planar waveguide circuit 170 is a hybrid planar waveguide circuit. As used herein, a hybrid planar waveguide circuit includes a continuous strip conductor, a portion of which is a stripline portion and a portion of which is a microstrip line portion. This is illustrated in FIG. 3, which shows a circuit portion 300 that includes a continuous strip conductor 310 over a ground plane 320. A microstrip line portion 330 runs over a portion of the ground plane 320 but is not associated with an overlying ground plane. A stripline portion 350 runs between the ground plane 320 and a ground plane 340.

Combining a stripline portion and a microstrip line portion of a continuous strip conductor is contrary to conventional practice. Discontinuities in electromagnetic (EM) fields at the transition between the two portions may, e.g., add complexity to the behavior of the waveguide that may require accommodation by the circuit design.

However, the disclosure recognizes that in some cases possible disadvantages of such discontinuities may be outweighed by advantages of access to the microstrip line portion 330. In one example embodiment, a microstrip line 360 is coupled to the microstrip line portion 330 by a discrete device 370. The discrete device 370 may be, e.g., a resistor, a capacitor or a diode. The microstrip line portion 330 provides the ability to attach the discrete device 370 to the continuous strip conductor 310 without concern for obstruction by overlying layers. This ability allows the designer greater freedom of selecting component values and functionality difficult to achieve with stripline alone.

In some cases, it may be desirable to limit the path length of the microstrip line portion 330 in relation to the total path length of the continuous strip conductor 310. It is believed that such design practice may reduce undesired artifacts resulting from the aforementioned EM discontinuities at the transition from the microstrip line portion 330 to the stripline portion 350.

Returning to FIG. 2A, the split-rings 210, 215 are configured as resonators, e.g. A microstrip line input 250 may provide an input signal 257 to the split-ring 210, e.g. An input capacitor 260 may capacitively couple the microstrip line input 250 to the split-ring 210. A ring capacitor 270 may capacitively couple ends of the split-ring 210. The split-ring may resonate when the input signal 257 has a frequency determined in part by the path length of the split-ring 210 and the values of the capacitors 260, 270. The split ring 215 also has a resonant frequency. The frequency may again be determined in part by the path length of the split ring 215 and the values of an output capacitor 265 and a ring capacitor 275.

The split-ring 210 is coupled to the split-ring 215 by the distributed capacitance and inductance therebetween. When the split-ring 210 responds resonantly to an input signal, a resonant response may be induced in the split-ring 215. The resonant signal on the split-ring 215 may then be coupled to the microstrip line output 255 through the output capacitor 265. Thus, the planar waveguide circuit 160 may function as a band pass filter, allowing the input signal 257 to pass from the microstrip line input 250 to an output signal 258 at the microstrip line output 255 when the conditions for resonance are satisfied. For the purpose of this discussion, the net signal path in the frame of reference of FIG. 2A is regarded as horizontal.

The resonant condition of the split-rings 210, 215 is generally met when the input signal has a frequency with a wavelength about twice the path length of the split-rings 210, 215. The capacitors 260, 270 may shift the resonant frequency in a tunable range about this frequency. In some embodiments, varactor diodes are used for the capacitors 260, 265, 270, 275 to provide a means to tune the pass-band of the filter formed by the split-rings 210, 215. Means of varying the capacitance of a varactor diode are known to those skilled in the pertinent art.

In a nonlimiting example, a filter with a tunable range of 107 to 200 MHz may be formed with split-rings 210, 215 having a strip conductor width of about 1.2 mm, impedance of about 50Ω, and length of about 362 mm. The metal levels 110, 120, 130 may be about 0.7 mil (17.8 μm) thick, and the dielectric levels 115, 125 may be about 62 mil (1.57 mm) thick. An input/output capacitance value in a range between about 5.5 pF to 18 pF and a ring capacitance value in a range between about 3.4 pF to 20 pF may be used to select a frequency in the tunable range.

The example dimensions recited may be altered as necessary to accommodate a particular design objective or manufacturing process. Moreover, while the example embodiment recites dimensions generally associated with printed circuit board (PCB) fabrication methods, a filter of the disclosure may also be fabricated using, e.g., conventional integrated circuit interconnect processes, flexible circuit processes, and the like.

A dielectric layer over a microstrip line portion may be, e.g., air or vacuum. The embodiment of the device 100 is illustrated with this configuration. In such cases, the dielectric permittivity above the microstrip line portion is about unity. In other embodiments, a solid dielectric layer may overlie the microstrip line portion. Such may be the case, e.g., where the device 100 is formed using a flexible circuit process or a semiconductor interconnect process. In such cases, an opening may be formed, using a conventional process, in the dielectric overlying the microstrip line portion to accommodate placement of a discrete component.

In some embodiments, the split-rings 210, 215 may include meander lines to increase the path length thereof. In this manner, the split-rings 210, 215 may be configured to resonate at a lower frequency (longer wavelength) than in the relatively simple configuration illustrated. While the general operating characteristics of the filter formed by the split-rings 210, 215 may be estimated by one skilled in the pertinent art, a more refined understanding of the filter characteristics may be determined using one of several full-wave simulators, such as, e.g., CST Microwave Studio by Sonnet Software, North Syracuse, N.Y., USA.

In some embodiments, the ground plane 240 is electrically floating, meaning that the DC voltage thereon is unconstrained by, e.g., a connection to a system ground. In some embodiments, the ground plane 240 is unbroken. Unbroken means that there are no openings through the ground plane 240 within the perimeter thereof. The ground level 110 may also be unbroken in the illustrated region, e.g., generally underlying the hybrid planar waveguide circuit 160. In some cases, the ground level 110 may be a system ground plane on which other circuits are formed. In these cases, the ground level 110 may include openings in regions not proximate the planar waveguide circuit 160 but may still be regarded as unbroken.

Figure 4A:
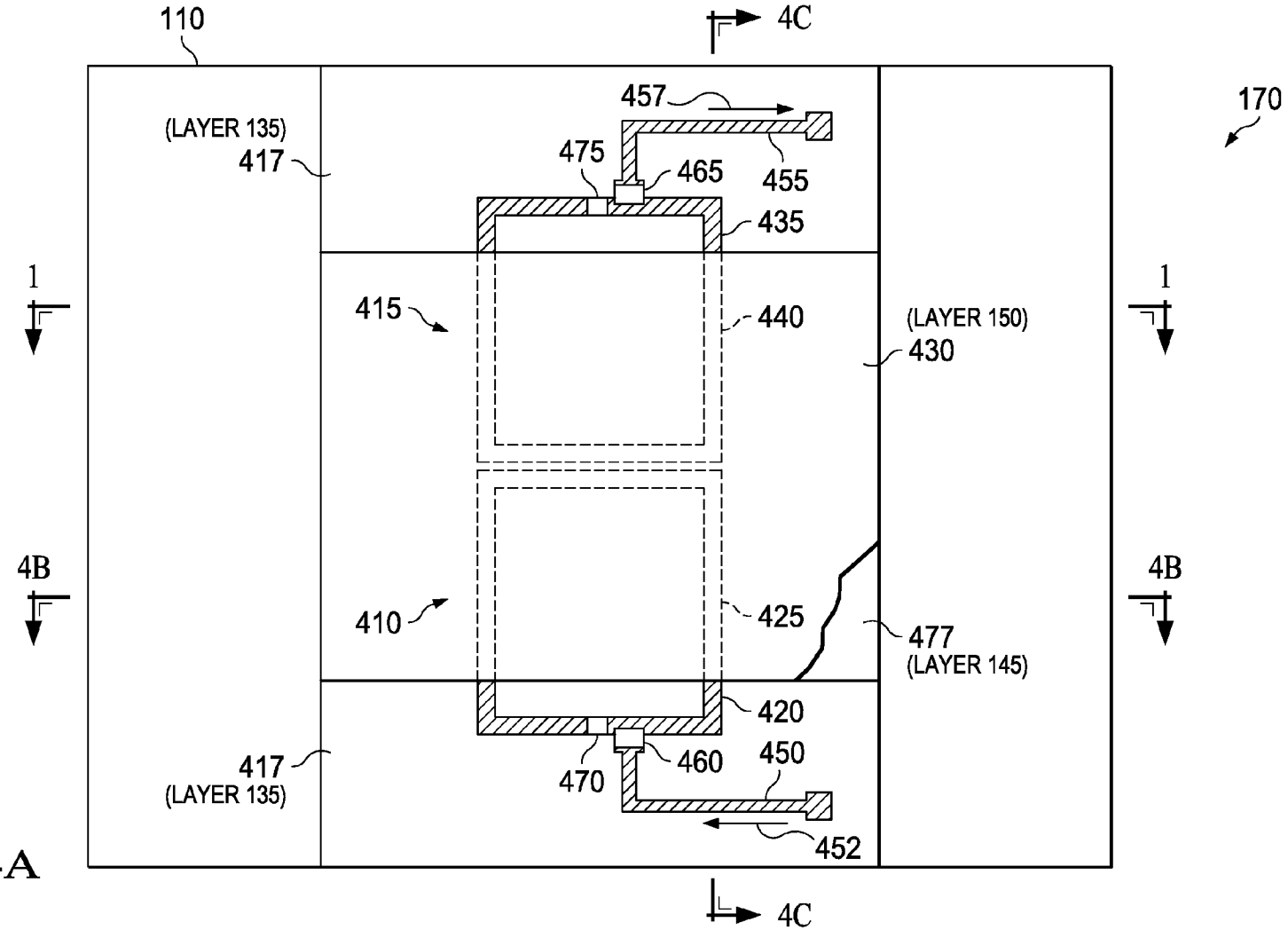
FIG. 4A is a plan view.
Figure 4B:
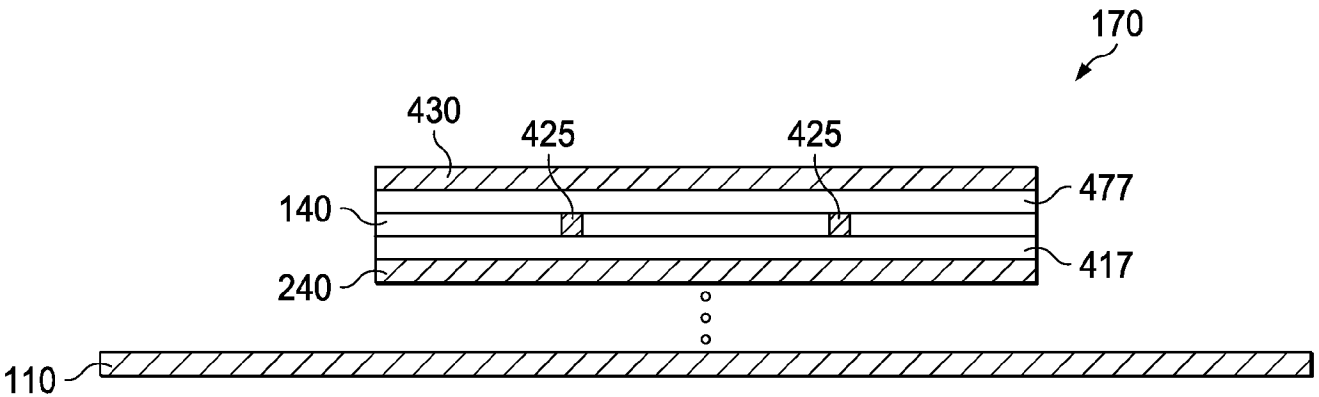
FIGS. 4B and 4C are sectional views of a hybrid planar waveguide circuit.
Figure 4C:
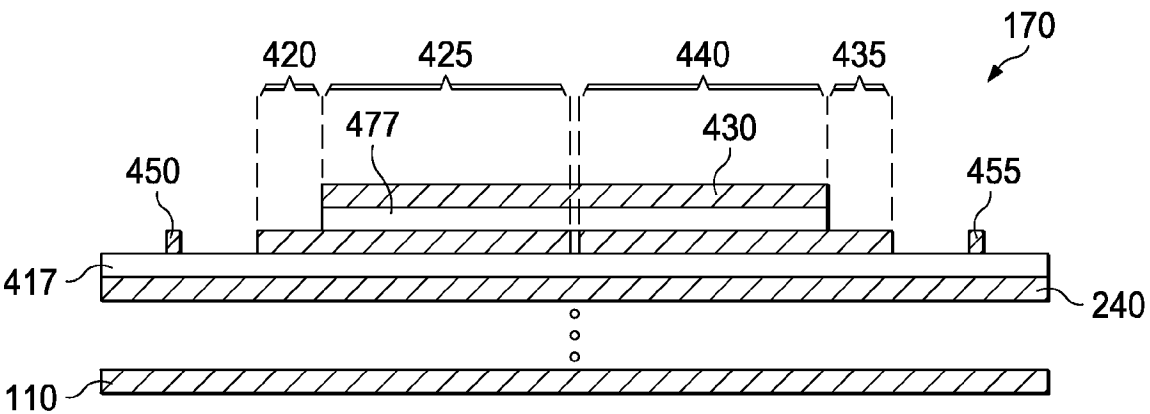

Turning to FIG. 4A, a plan view of an example embodiment of the planar waveguide circuit 170 is shown. Only the levels 110, 130, 135, 140, 145 and 150 are shown for clarity. FIGS. 4B and 4C illustrate sectional views of the planar waveguide circuit 170 to clearly view the relationship among the levels. Only the levels 110, 130, 135, 140, 145 and 150 are shown in the sectional views for clarity. The section of FIG. 4B is taken horizontally through FIG. 4A as noted therein, and the section of FIG. 4C is taken vertically.

Referring to FIG. 4A, the planar waveguide circuit 170 includes, e.g., two split-rings 410, 415. The split-rings 410, 415 are supported by a dielectric spacer 417 formed from the insulator layer 135. The split-rings 410, 415 each include a microstrip line portion and a stripline portion. For example, the split-ring 410 includes a microstrip line portion 420 and a stripline portion 425. The stripline portion 425 is that portion of the split-ring 410 located between a ground plane 430 and the ground plane 240, e.g. A microstrip line portion 435 and a stripline portion 440 of the split-ring 415 are similarly defined. The microstrip line portion 420 is that portion of the split-ring 410 that is not associated with an overlying ground plane. The relationship of the microstrip line portions 420, 435 and the stripline portions 425, 440 to the ground planes 240, 430 is illustrated in the sectional views of FIGS. 4B and 4C. The split-rings 410, 415 are hybrid planar waveguide circuits, by virtue of including a continuous strip conductor with a microstrip line portion and a stripline portion.

As noted previously, the ground plane 240 as configured in the device 100 is shared by both the planar waveguide circuit 160 and the planar waveguide circuit 170. In other embodiments, the ground plane may not be shared. Such may be the case, e.g. when device has more than two circuit levels, wherein two circuit levels of interest are separated by one or more intervening circuit levels. Whether shared or not, a ground plane located between two circuit levels is expected to shield one circuit level from another. Thus, cross-talk between the circuit levels is expected to be significantly less than for a conventional configuration in which filters may be placed adjacent to each other on a same circuit level, e.g.

As was the case for the planar waveguide circuit 160, the split-rings 410, 415 may be configured as resonators, e.g., and are illustrated as such without limitation. With continuing reference to FIG. 4A, a microstrip line input 450 may provide an input signal 452 to the split-ring 410, e.g. A microstrip line output 455 may provide an output signal 457 from the split-ring 415, e.g. An input capacitor 460 may capacitively couple the microstrip line input 450 to the split-ring 410, and an output capacitor 465 may capacitively couple the microstrip line 455 to the split-ring 415. Ring capacitors 470, 475 may respectively capacitively couple ends of the split-rings 410, 415. The input signal 452 may be coupled to the output signal 457 at a frequency determined in part by the path length of the split-rings 410, 415 and the values of the capacitors 460, 465, 470, 475.

In a nonlimiting example, a filter with a tunable range of 173-363 MHz may be formed with split-rings 410, 415 having a waveguide width of about 1.2 mm, an impedance of about 50Ω, and length of about 183 mm. The metal levels 130, 140, 150 may be about 0.7 mil (17.8 μm) thick, and the dielectric levels 135, 145 may be about 50 mil (1.27 mm) thick. An input/output capacitance value in a range between about of 3.5 pF to 17 pF, and a ring capacitance value in a range between about 3.4 pF to 20 pF may be used to select a frequency in the tunable range.

Thus, in a manner analogous to the planar waveguide circuit 160, the planar waveguide circuit 170 may function as a band pass filter. As is the case for the planar waveguide circuit 160, the pass band of the filter of the planar waveguide circuit 170 may be tuned by the use of varactor diodes for the capacitors 460, 465, 470, 475. In some embodiments the net path of the input signal 452 to the output signal 457 may be vertical as illustrated, e.g., orthogonal to the signal path of the planar waveguide circuit 160. This configuration may be useful, e.g., in providing unimpeded access to the microstrip line input 250 or the microstrip line output 255 to provide input and output signals thereto.

FIG. 4B illustrates a sectional view of the hybrid planar waveguide circuit 170. The planar waveguide circuit 170 includes portions of the layers 130, 135, 140, 145 and 150. A dielectric layer 477 formed from the insulating layer 145 supports the ground plane 430. The layers are located over the ground layer 110. Sections of the stripline portions 425 are shown located between the ground planes 240, 430. Any number of circuits, that may additionally be planar waveguide circuits, may be located between the planar waveguide circuit 170 and the substrate 105 (or the ground level 110). In the embodiment illustrated by FIG. 1, a single planar waveguide circuit, e.g., the planar waveguide circuit 160, is located between the planar waveguide circuit 170 and the ground level 110.

FIG. 4C illustrates a sectional view of the planar waveguide circuit 170 taken vertically therethrough as indicated in FIG. 4A. This sectional view illustrates the microstrip line portions 420, 435 that are not associated with an overlying ground plane. Stripline portions 425, 440 are located between the ground plane 430 and the ground plane 240.

The device 100 may be formed by conventional or novel methods. In one embodiment, a conventional multi-level printed circuit board (PCB) fabrication method is used. In such an embodiment, the dielectric material may be, e.g., FR4, and the conductor may be, e.g., copper. A circuit specification may be provided to a PCB manufacturer, and may include conductor paths and dielectric cutouts, as appropriate. Those skilled in the pertinent art are knowledgeable regarding the specific requirements of such specifications. In other embodiments, a ceramic multi-level process may be used with an LTCC dielectric and a gold or silver conductor.

Figure 5:
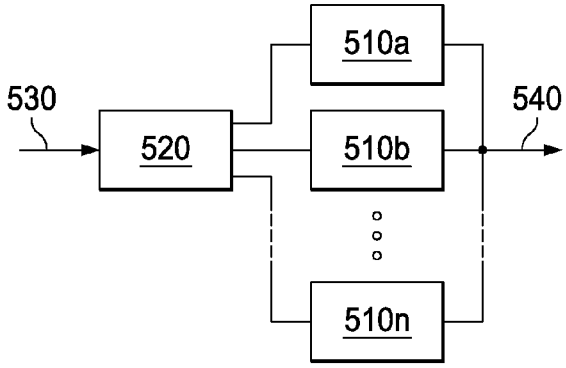
FIG. 5 illustrates multiple filters and a switch.

FIG. 5 illustrates an embodiment of a configuration of filters 510*a*, 510*b*, . . . 510*n*, collectively referred to as filters 510, connected to a switch 520. In some embodiment, a power divider may be used in place of the switch 520. The filters 510 may each be, e.g., a planar waveguide circuit consistent with the disclosure. The switch 520 is configurable to route an input signal 530 to one of the filters 510. In some embodiments, a switch having a low insertion loss (less than about 0.5 dB) and low reflection is desirable. The switch 520 may be external to the device 100 or integrated therewith on a common substrate. RF connectors may be attached to inputs and outputs of the filters 510*a*, 510*b*, . . . 510*n* to provide connection to the switch 520. Outputs of the filters may be connected in parallel to provide an output 540. The filters 510 may each be, e.g., a planar waveguide circuit consistent with the disclosure. When the filters 510 are arranged as described herein, e.g. vertically stacked over a substrate as illustrated in FIG. 1, the assembly may be configured as a high bandwidth, multiband filter. It is expected, e.g., that embodiments consistent with the disclosure may provide a stacked filter with a tunable range of at least about 50%. The configuration provides significant improvement over conventional stripline filter designs by reducing the area of the substrate consumed by the filter, and providing a low profile. Such a reduction of area may find particular utility in, e.g., mobile communications devices.

When the circuits 160, 170 are configured as tunable filters, the placement of a smaller (higher frequency) filter over a larger (lower frequency) filter may result in a combined filter with a tunable range larger than would be possible with either filter used individually. The total area of an underlying substrate consumed by the combined filter is no larger than the area of the largest (lowest frequency) filter at the bottom of the filter stack.

In the illustrated embodiment, a tunable range of the combined filter, e.g., the circuits 160, 170 configured as described in the example embodiments, is about 107 MHz to about 363 MHz. This frequency range is greater than that generally obtainable from a single split-ring filter. The tunable range may be extended further by, e.g., stacking the circuits 160, 170 with a third filter. In some cases, it may be preferable to configure the individual filters to have overlapping tunable ranges to ensure there are no gaps in coverage. In principle, an arbitrary number of filters may be stacked, though other practical considerations may limit the number, such as limitations on the number of metal levels that may be provided by a manufacturer. Moreover, a combined filter operating in a higher frequency range, e.g., in the GHz range, may be formed using appropriately reduced dimensions of elements of the filters 160, 170.

Figure 6:
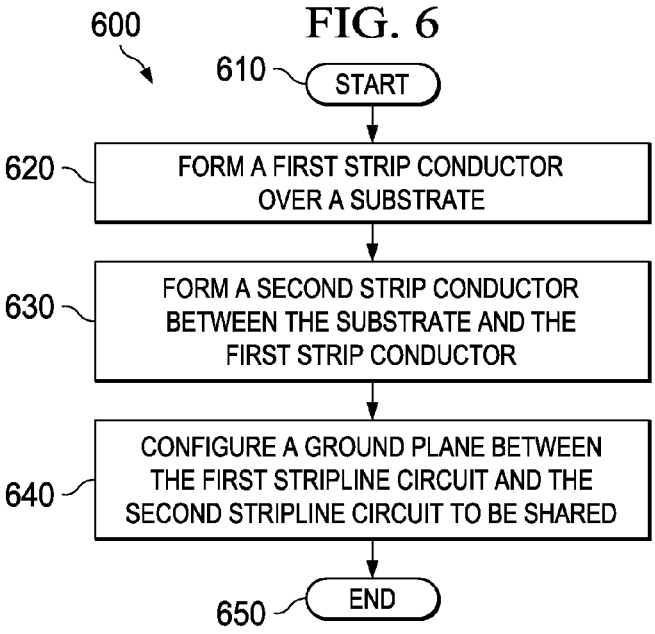
FIGS. 6 and 7 are methods of the disclosure.

Turning now to FIG. 6, a method 600 of the disclosure is illustrated. The method begins with a step 610. In a step 620, a first planar waveguide circuit with a strip conductor is formed over a substrate. The substrate may be, e.g., a ground plane or a dielectric. In a step 630, a second planar waveguide circuit with a strip conductor is formed over the substrate. At least one of the first and second planar waveguide circuits is a hybrid planar waveguide circuit, e.g., includes both a stripline portion and a microstrip line portion. The second planar waveguide circuit is located between the first planar waveguide circuit and the substrate. In an optional step 640, a ground plane located between the first and second planar waveguide circuits may be configured to be shared by the first and second planar waveguide circuits, or may be configured to be electrically floating. The method ends with a step 650.

Figure 7:
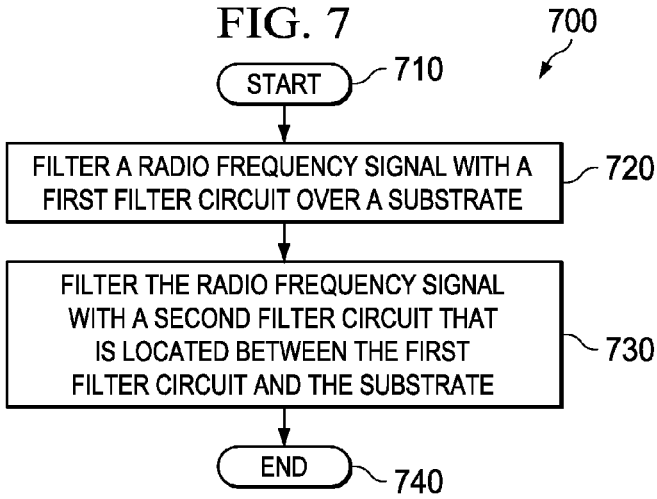

FIG. 7 illustrates a method 700. In the illustrated method, ordering of steps does not necessarily imply that the steps are performed in a sequential manner. The method begins with a step 710. In a step 720, an RF signal is filtered by a first planar waveguide filter circuit. In a step 730, the RF signal is filtered by a second planar waveguide filter circuit. The second filter circuit is located between the first filter circuit and the substrate. At least one of the first and the second filter circuits is a hybrid planar waveguide circuit. The method ends with a step 740.

Those skilled in the art to which this application relates will appreciate that other and further additions, deletions, substitutions and modifications may be made to the described embodiments.

What is claimed is:

1. An electronic device, comprising:

a first strip conductor formed from a first metal level over a substrate; and a second strip conductor formed from a second metal level over said substrate, said second metal level being conductively isolated from said first metal level and located between said first strip conductor and said substrate, wherein said first strip conductor includes a first stripline portion and a first microstrip line portion, and said second strip conductor includes a second stripline portion and a second microstrip portion.

2. The electronic device as recited in claim 1, further comprising a shared ground plane located between and shared by said first strip conductor and said second strip conductor.

3. The electronic device as recited in claim 1, further comprising a floating ground plane that is electrically floating and is located between said first strip conductor and said second strip conductor.

4. The electronic device as recited in claim 1, further comprising a discrete component attached to said microstrip line portion.

5. The electronic device as recited in claim 1, wherein a first band pass filter comprises said first strip conductor, and a second band pass filter comprises said second strip conductor.

6. The electronic device as recited in claim 5, further comprising a switch or a power divider configured to selectively couple an input signal to either said first or said second band pass filter.

7. The electronic device recited in claim 5, wherein said first band pass filter is configured to have a first center frequency and said second band pass filter is configured to have a lower second center frequency.

8. An electronic device, comprising:

a first ground plane;

a second ground plane located over said first ground plane; and a first planar waveguide circuit located over said first ground plane and including a first split ring, with said first split ring including a first microstrip line portion that is uncovered by said second ground plane and a first stripline portion located between said first and second ground planes.

9. The electronic device of claim 8, further comprising a second split ring located over said first ground plane, with said second split ring including a second microstrip line portion that is uncovered by said second ground plane and a second stripline portion located between said first and second ground planes such that said first and second stripline portions are capacitively coupled.

10. The electronic device of claim 8, wherein said second ground plane underlies a second planar waveguide circuit that includes a third split ring.

11. The electronic device of claim 10, further comprising a fourth split ring coplanar with and capacitively coupled to said third split ring.

12. The electronic device of claim 11, wherein said first and second split rings are configured to operate as a first filter with a first frequency response, and said third and fourth split rings are configured to operate as a second filter with a second frequency response.

13. A method, comprising:

forming a first strip conductor over a substrate;

forming a second strip conductor between said substrate and said first strip conductor, said second strip conductor being conductively isolated from said first strip conductor, wherein said first strip conductor includes a first stripline portion and a first microstrip line portion, and said second strip conductor includes a second stripline portion and a second microstrip portion.

14. The method as recited in claim 13, further comprising locating a shared ground plane between said first strip conductor and said second strip conductor.

15. The method as recited in claim 13, further comprising locating a floating ground plane between said first strip conductor and said second strip conductor.

16. The method as recited in claim 13, further comprising configuring a switch to selectively couple an input signal to either said first band pass filter or to said second band pass filter.

17. The method as recited in claim 13, further comprising configuring said first band pass filter to operate with a first center frequency and configuring said second band pass filter to operate with a second greater center frequency.

18. The method as recited in claim 13, further comprising attaching a discrete component to said microstrip line portion.

19. A method, comprising:

filtering a radio frequency signal with a first filter circuit that is located over a substrate, comprises a first strip conductor and is configured to have a first frequency response;

filtering said radio frequency signal with a second filter circuit located between said first filter circuit and said substrate, comprises a second strip conductor, and is configured to have a different second frequency response; and selectively directing said radio frequency signal to either said first filter circuit or said second filter circuit, wherein at least one of said first and said second strip conductors includes a stripline portion and a microstrip line portion.

20. The method as recited in claim 19, wherein a floating ground plane is located between said first strip conductor and said second strip conductor.

21. The method as recited in claim 19, wherein a discrete component is attached to said microstrip line portion.

22. A method of forming an electronic device, comprising:

forming a first ground plane;

forming a second ground plane over said first ground plane; and forming a first planar waveguide circuit over said first ground plane, said first circuit including a first split ring that includes a first microstrip line portion that is uncovered by said second ground plane and a first stripline portion that is located between said first and second ground planes.

23. The method of claim 22, wherein said first planar waveguide circuit includes a second split ring that includes a second microstrip line portion that is uncovered by said second ground plane and a second stripline portion that is located between said first and second ground planes and is capacitively coupled to said first stripline portion.

24. The electronic device of claim 22, further comprising forming over said second ground plane a second planar waveguide circuit that includes a third split ring.

* * * * *